United States Patent [19]

Harding et al.

[11] 4,031,735

[45] June 28, 1977

[54] APPARATUS FOR JOINING WIRES

[75] Inventors: John Patrick Harding, Bushey; David Sydney Butler, Hassocks; Graham Keith Whitehead, Harefield, Uxbridge, all of England

[73] Assignee: The Post Office, London, England

[22] Filed: Feb. 24, 1976

[21] Appl. No.: 660,979

[30] Foreign Application Priority Data

Feb. 27, 1975 United Kingdom ..... 8270/75

[52] U.S. Cl. ..... 72/394; 29/747; 72/410; 72/451

[51] Int. Cl.[2] ..... B21D 7/06

[58] Field of Search ..... 72/451, 410, 452, 412, 72/394, 403; 29/203 DT; 81/363

[56] References Cited

UNITED STATES PATENTS

| | | | |
|---|---|---|---|
| 2,647,814 | 8/1953 | Chilton | 72/410 |
| 3,015,824 | 1/1962 | Richardson | 72/410 |
| 3,571,890 | 3/1971 | Brehm | 72/410 |
| 3,688,553 | 9/1972 | Demler | 72/410 |
| 3,837,211 | 9/1974 | Gress | 29/203 DT |

*Primary Examiner*—C.W. Lanham
*Assistant Examiner*—Gene P. Crosby
*Attorney, Agent, or Firm*—Hall & Houghton

[57] ABSTRACT

Apparatus for joining together two wires by deforming a crimping clip around the wires. The apparatus has a pair of crimping jaws and a support member for the clip, the jaws and support member moving into a crimping position to deform the clip around the wires. The jaws and support member are moved by a toggle linkage which develops an output force which varies with the condition of the toggle and increases as the jaws and support member move toward the crimping position.

5 Claims, 10 Drawing Figures

APPARATUS FOR JOINING WIRES

This invention relates to apparatus for joining together pairs of wires through the use of crimping clips and is concerned, more especially, with apparatus which is suitable for joining together the corresponding wires of telephone cables to make an electrical connection therebetween.

The present invention provides apparatus for joining together a pair of wires, including crimping jaws which are movable into a crimping position to deform a crimping clip to grip and thereby join together the wires, and a support member which is adapted to carry the clip and is also movable into a crimping position to co-operate with the jaws in the deformation of the clip, the crimping jaws and support member being movable by a toggle linkage operable to develop an output force which varies with the condition of the toggle and increases as the jaws and/or support member move(s) towards the crimping position.

Preferably, the output force developed by the toggle linkage increases during deformation of the clip. It is of advantage if, during a crimping operation, the crimping jaws move into the crimping position before the support member, the output force developed by the toggle linkage then increasing as the support member moves into the crimping position.

In an embodiment of the invention, the toggle linkage comprises a driving link to which two linkage members are pivotally coupled at one end, the other end of one of the linkage members being fixed and the other end of the second linkage member being pivotally coupled to one end of an actuating link which moves the jaws and support member, the other end of the actuating link being fixed.

Preferably, the toggle linkage is pneumatically-driven: in the embodiment of the invention referred to above, the driving link is pivotally coupled to a pneumatically-actuated piston-and-cylinder assembly.

By way of example, a crimping machine constructed in accordance with the invention will be described with reference to the accompanying drawings, in which.

Figure 4A:
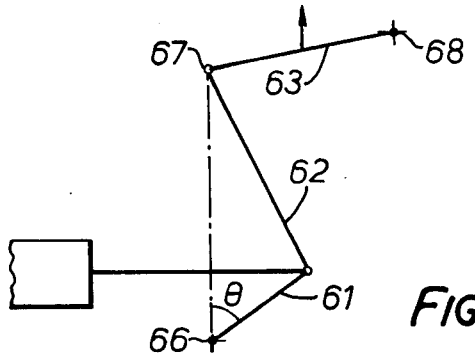
Figure 5:
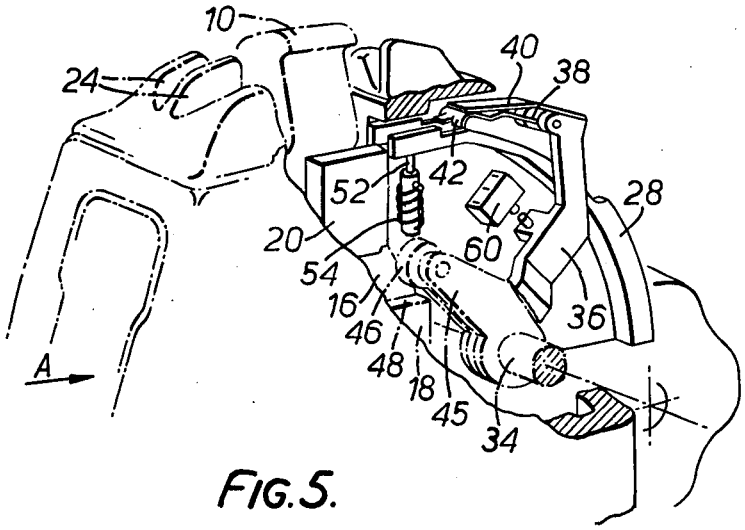
Figure 6:
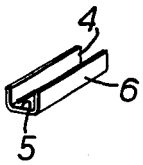
Figure 7:
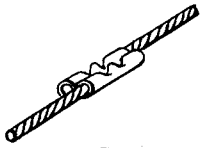

FIGS. 4*a* and *b* illustrate the variation in the output force of the toggle linkage of the machine;

FIG. 5 is a fragmentary perspective view of the machine;

FIG. 6 is a perspective view of a clip for use in the machine;

FIG. 7 is a perspective view of a joint employing the clip shown in FIG. 6, and

Figure 8:
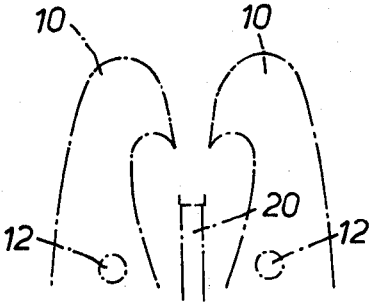
Figure 9:
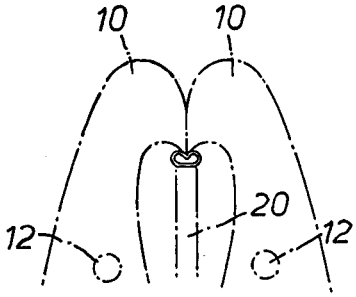

FIGS. 8 and 9 are diagrammatic illustrations of two stages of a crimping operation.

Figure 1:
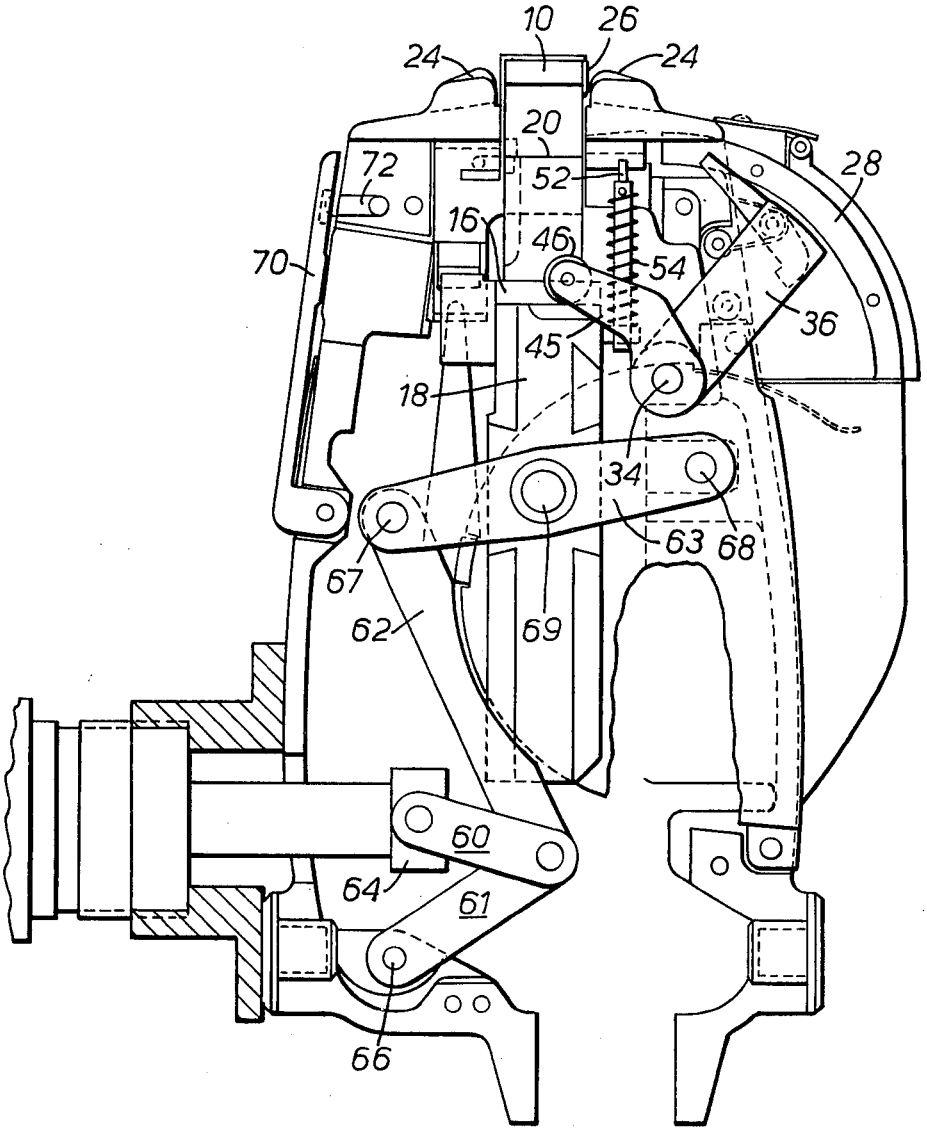
FIG. 1 is a diagrammatic cross sectional view of the machine, parts having been omitted for clarity.
Figure 2:
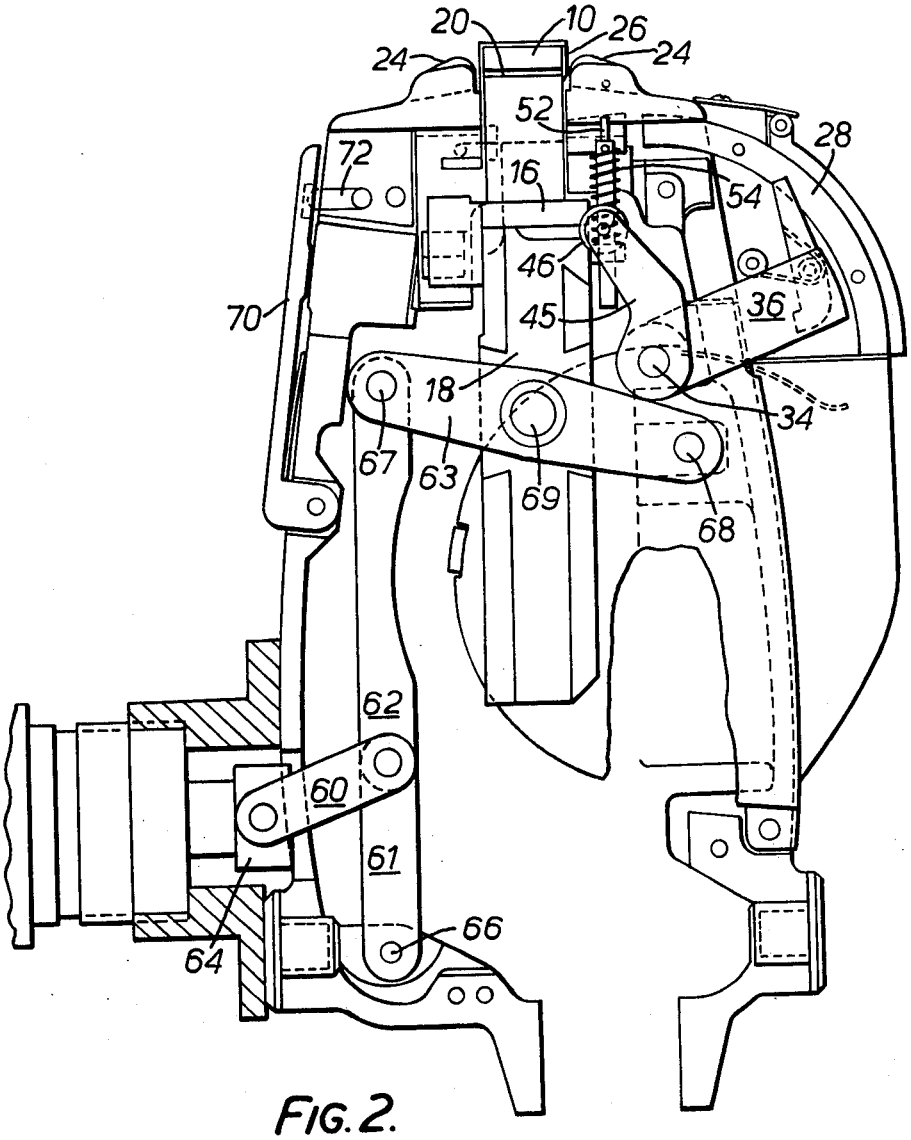
FIG. 2 is a view similar to FIG. 1 but showing the machine at another stage of operation.

The machine illustrated in FIGS. 1, 2 and 5 of the drawings is for joining together insulated wires with crimping clips of the type shown in FIG. 6. Clips of this type are described in British patent specification No. 1,176,362, and reference may be made to that specification for a more detailed description of the clips and of their use, if required. Briefly, the clips comprise a trough-shaped metal section 4 backed with an insulating cover 6, the base of the trough-shaped metal section being pierced to provide a series of projecting metal tangs 5. Two wires to be joined are placed lengthwise of a clip and the clip is crimped on to the wires, the sides of the trough-shaped section being bent over towards each other and the tangs in the base being driven into the wires to make electrical contact therewith; simultaneously with or immediately following the making of the crimp, the free ends of the wires are cut off adjacent the ends of the clip, the final joint being as shown in FIG. 7.

Referring to FIGS. 1, 2 and 5, the machine has a pair of pivotally-mounted crimping jaws 10, the under surfaces of which are curved. Only one of the jaws 10 appears in the drawings. The loweer end of each jaw 10, as seen in the drawings, carries a cam follower (not shown) which co-operates with a cam profile 16 on a vertically-reciprocable actuating member 18. The actuating member 18 is operated by a pneumatically-driven toggle linkage 60 to 63 described below.

Adjacent the jaws 10 are guide channels 24 for wires which are to be joined together with a crimping clip, and mounted on a side face of each jaw 10 is a knife blade 26 for trimming the surplus end of each wire. Only one of the knife blades appears in the drawings.

Crimping clips are fed to the jaws 10 along an arcuate channel-section guideway 28 from a magazine in which is disposed a cassette containing a strip of clips.

This strip consists of a channel of electrically insulating material whose walls have been severed at intervals of the length of one clip to provide a series of insulating covers 6 (FIG. 6); the un-severed floor of the channel remains as a hinge connecting adjacent clips. individual metal liner inserts 4 with the metal tangs 5 are disposed within the channel, the walls of the insulating channel being inwardly biased to retain the inserts within the channel. A feeding mechanism, including a feed arm 36 and clip locating pin 52, is provided in the machine for moving the strips of clips forward along the guideway 28 and positioning a clip at the jaws 10 in readiness for a crimping operation. The feeding mechanism forms no part of the present invention but will, for completeness, be described briefly below.

The arm 36 of the mechanism is carried by a rotatable shaft 34 at the centre of the arc of the guideway 28. At the outer end of the feed arm 36 there is a pivotally mounted pawl or notch engaging portion 38 whose free end is urged radially inwardly towards the guideway 28 by a leaf spring 40. The free end of the pawl is bent to provide a pair of clip-engaging forks 42. Also carried on the shaft 34, and in fixed angular relationship to the feed arm 36, is an actuator arm 45 whose free end is provided with a cylindrical cam follower 46 which co-operates with a further camming surface 48 provided on the actuating member 18. Below the guideway 28 adjacent the plunger 22 is a clip-locating pin 52 which is moved upwards by upward movement of the actuating member 18; a compression spring 54 accommodates the considerable difference in travel between the actuating member and the pin 52 and serves to limit the force applied by the pin to a clip being held.

The toggle linkage 60 to 63 which operates the actuating member 18 is driven by a pneumatically-actuated piston 64 located outside the head of the crimping machine. The piston 64 is pivotally coupled to one end of the link 60, the other end of the link being pivotally coupled to one end of links 61 and 62. The other end of link 61 is pivotally coupled at 66 to the machine head while the other end of link 62 is pivotally coupled at 67 to one end of the fourth link 63. The other end of link 63 is pivotally coupled at 68 to the machine head and the mid-point of the link is coupled at 69 to the actuating member 18.

Figure 3:
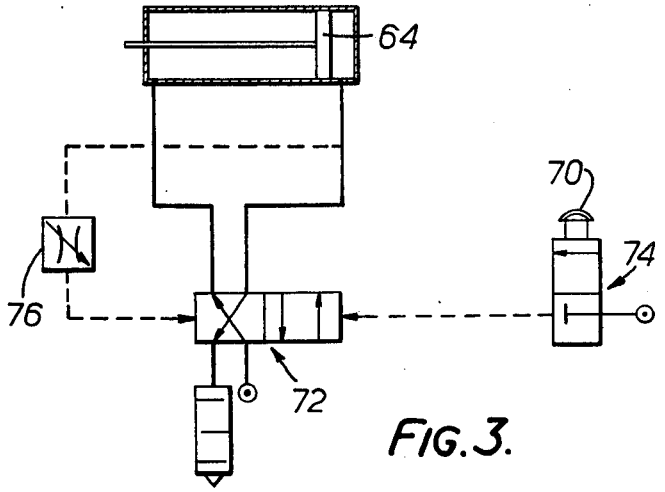
FIG. 3 illustrates the pneumatic control circuit of the mchine.

The pneumatic control circuit of the piston 64 is illustrated in FIG. 3. The piston is actuated by compressed air from a cylinder under the control of a start lever 70 and associated valve 74, a changeover valve 72 and a variable restrictor 76. Only the start lever 70 and the changeover valve 72 are indicated in FIGS. 1 and 2.

When the machine is ready for use, the piston 64 has been moved to the right as seen in the drawings and the condition of the toggle linkage 60 to 63 is as shown in FIG. 1. The actuating member 18 is withdrawn and the first crimping clip of the strip in guideway 28 has been positioned by the feeding mechanism on the top of a plunger 20 formed by the uppermost portion of the actuating member. The clip-engaging forks 42 of the feeding mechanism are located between the second and third clips of the strip in guideway 28, the second clip being positioned above the clip-locating pin 52.

Electrical conductors to be joined are laid one in each guide channel 24. The start lever 70 is depressed, actuating the associated valve 74 (FIG. 3) and thereby applying compressed air to the changeover valve 72 to move the latter to the left as shown in FIG. 3. Operation of the changeover valve 72 moves the piston 64 to the left as seen in the drawings, bringing the toggle linkage 60 to 63 into the condition shown in FIG. 2 and driving the actuating member 18 upwards. The clip-locating pin 52 is resiliently urged against the underside of the second clip, whilst the plunger 20 ruptures the hinge between the first and second clips. The clip positioned on top of the plunger 20 is carried upwards until it is level with the curved under surfaces of the crimping jaws 10 and the conductors to be joined lie between the sides of the clip. Simultaneously, the jaws 10 are brought together by the action of the cam profiles 16 on the actuating member 18. Continued upward movement of the plunger 20 causes the clip to be crimped on to the conductors as already described, the surplus ends of the joined conductors being trimmed by the knife blades 26.

Movement of the jaws 10 during a crimping operation is illustrated, diagrammatically, in FIGS. 8 and 9. FIG. 8 illustrates the jaws 10, pivotally mounted at 12, in the open position prior to a crimping operation: the actuating member 18 is withdrawn and an uncrimped clip is positioned on the top of plunger 20. FIG. 9 shows the jaws 10 and plunger 20 at the end of a crimping operation: the jaws 10 have been brought together, causing the sides of the clip to fold over the wires and, against the pressure of the further upward movement of the plunger 20, clamping the edges of the clip home to form the joint of FIG. 7.

The toggle linkage 60 to 63 of the machine reaches the FIG. 2 condition when the piston 64 is at the left hand limit of its travel. Thereupon, the compressed air drive on the right side of the piston is vented to the preset variable restrictor 76 which changes the condition of the changeover valve 72 to return the pneumatic control circuit to its start position.

The upward movement of the actuating member 18 during the crimping operation displaces the actuating arm 45 and causes the pawl 38 to be retracted so that the forks 42 ride up out of the gap between the second and third clips and move back to the gap between the third and fourth clips. During this movement of the forks 42, the strip of clips is held by the locating pin 52. When the actuating member is retracted after a crimping operation, the camming surface 48 falls and the strip of clips in guideways 28 is moved forwards by the feeding mechanism until another clip is positioned on the plunger 20 and the machine is again ready for use.

Figure 4B:
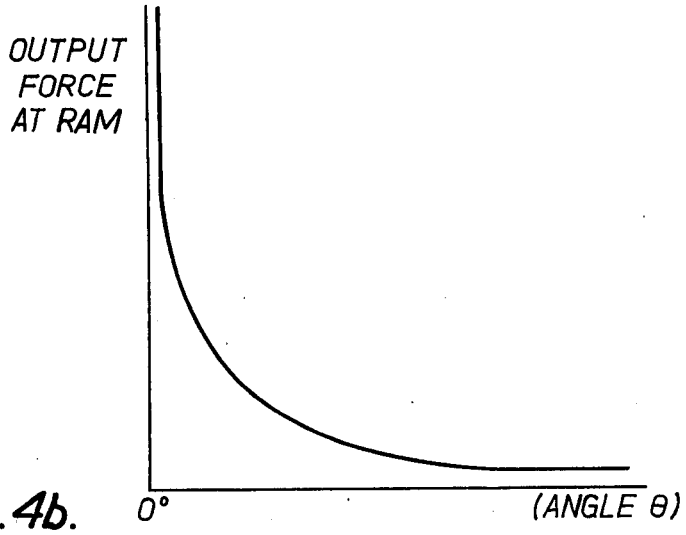

If it is assumed that the output force of the piston 64 during a crimping operation is constant, then the output force of the toggle linkage 60 to 63 (that is, the force applied to the actuating member 18) varies with the condition of the linkage. The form that the variation takes is illustrated in FIG. 4*b*, the condition of the toggle linkage being represented by the angle $\theta$ between the link 61 and the line joining the pivots 66, 67 as indicated in the diagram of the linkage given in FIG. 4*a*. It will be seen that as the angle $\theta$ decreases (corresponding to upward movement of the actuating member 18) the output force of the toggle linkage 60 to 63 increases, slowly at first but then more rapidly and rising, theoretically, to infinity when the links 61 and 62 are aligned.

It is possible, using the toggle linkage 60 to 63 as shown in FIGS. 1 and 2, to obtain a comparatively large output force from a small input force as the angle $\theta$ approaches zero, so that a satisfactory crimping force can be obtained from a comparatively small piston 64 or comparatively low compressed air pressures. Moreover, the nature of the variation in the output force of the toggle linkage makes it possible to ensure that the crimping jaws 10 reach the closed position while the output force is comparatively small. Referring to FIG. 4*b* it can, for example, be arranged that the crimping jaws 10 reach the closed position at $\theta = 25°$ while the output force is comparatively small, the final crimping force then being developed as the angle $\theta$ decreases further. Such an arrangement has the advantage of enabling a crimping operation to be halted before the full crimping force is developed in the event of a foreign object being caught between the jaws 10.

The compressed air cylinder supplying the control circuit of FIG. 3 is preferably rechargeable from a portable compressor: such recharging need only take a few minutes. The pneumatic drive for the toggle linkage 60 to 63 can be lighter and less bulky than an equivalent hydraulic drive, and this is of importance when the crimping machine is to be used in locations not accessible by road. It is also possible for the pressure source to be located at a greater distance from the machine head than when a hydraulic drive is employed, this being of particular advantage when the crimping machine is to be used in a confined space.

We claim:

1. Apparatus for joining together a pair of wires by deforming a crimping clip to grip and thereby join the wires, the apparatus including crimping jaws which are movable into a crimping position to deform the crimping clip; a support member which is adapted to carry the clip and is also movable into a crimping position to co-operate with the jaws in the deformation of the clip, and a toggle linkage for moving the crimping jaws and support member, the toggle linkage being operable to develop an output force which varies with the condition of the toggle and increases as the jaws and support member move towards the crimping position, said toggle linkage comprising a driving link; two linkage members each pivotally coupled at one end to the driving link, the other end of one of the linkage members being fixed; and an actuating link which is pivotally coupled at one end to the other end of the second linkage member, the actuating link being fixed at its other end and being connected to move the jaws and support member.

2. Apparatus as claimed in claim 1, in which the toggle linkage is operable to develop an output force which increases during deformation of the clip.

3. Apparatus as claimed in claim 1, in which, during deformation of the clip, the jaws reach the crimping position before the support member, the toggle linkage then being operable to develop an increasing output force as the support member moves into the crimping position.

4. Apparatus as claimed in claim 1, in which the toggle linkage is pneumatically-driven.

5. Apparatus as claimed in claim 1, including a pneumatically-actuated piston-and-cylinder assembly to which the driving link is pivotally coupled.

* * * * *